United States Patent [19]

Delacretaz et al.

[11] Patent Number: 4,909,019

[45] Date of Patent: Mar. 20, 1990

[54] PROCESS AND APPARATUS FOR PACKAGING AN ARTICLE

[75] Inventors: Rene Delacretaz, Bournens; Serge Schor, Ecublens, both of Switzerland

[73] Assignee: SAPAL Societe Anonyme des Plieuses Automatiques, Ecublens, Switzerland

[21] Appl. No.: 192,922

[22] Filed: May 12, 1988

[30] Foreign Application Priority Data

May 12, 1987 [FR] France ..... 87-06760

[51] Int. Cl.[4] ..... B65B 11/02

[52] U.S. Cl. ..... 53/463; 53/466

[58] Field of Search ..... 53/463, 466, 449, 176, 53/229, 234, 379, 388

[56] References Cited

U.S. PATENT DOCUMENTS

| | | | |
|---|---|---|---|
| 1,572,256 | 2/1926 | Van Buren | 53/234 X |
| 1,818,497 | 8/1931 | Milmoe | 53/229 X |
| 2,443,952 | 6/1948 | Gilbert | 53/234 |
| 2,540,430 | 2/1951 | Cornock | 53/229 |
| 2,590,427 | 3/1952 | Mackenzie | 53/229 |
| 4,006,577 | 2/1977 | Schoppee | 53/234 X |
| 4,495,745 | 1/1985 | Crescenzo | 53/234 X |
| 4,648,236 | 3/1987 | Knecht | 53/234 |

FOREIGN PATENT DOCUMENTS

| | | | |
|---|---|---|---|
| 2106535 | 10/1971 | Fed. Rep. of Germany | 53/234 |
| 0592746 | 9/1947 | United Kingdom . | |

*Primary Examiner*—John Sipos

*Attorney, Agent, or Firm*—Sandler & Greenblum

[57] ABSTRACT

A method and apparatus for packaging an article such as, for example, a chocolate bar or other food product. In a preferred embodiment, the apparatus includes a conveyor system including a portion which leads the articles to a rotary inverter subsequent to an apparatus which folds a wrapper partially around the article. The inverter turns the article over to have the lower surface of the article face upwardly for having the final folds of the wrapper to be folded against the lower surface. The wrapper is preferably made from thermosealable material. Around the periphery of the inverter are workstations which preheat the thermosealable wrapper; apply pressure to cool the wrapper thereby sealing it; and fold the wrapper to create an extra flap with lateral folds projecting from the article. Downstream of the inverter is a workstation which seals the lateral folds, by heating, applying pressure to them, and cooling them. The lateral folds are supported from above during sealing by a support and guidance device. Lastly, a workstation performs the folding of the lateral folds and the extra flap against the lower surface of the article. Either the lateral folds are first folded against the lower surface of the article, with the extra flap folded over them or the extra flap is first folded against the lower surface of the article, after which the lateral folds are folded. In the latter configuration, an open-sleeve printed band is placed over the wrapped article for a more attractive appearance.

27 Claims, 5 Drawing Sheets

PROCESS AND APPARATUS FOR PACKAGING AN ARTICLE

BACKGROUND OF THE INVENTION

1. Field of the Invention

The present invention relates to a process for packaging an article, particularly a food product such as, for example, a chocolate bar having a substantially rectangular shape, in a sealed package. By means of the present invention the product is transported on a conveyor system through a number of workstations by which a sheet of substantially rectangular thermosealable packaging material is positioned around the product during the course of its movement by the conveyor system. By means of sequential manipulation steps, the packaging material is wrapped around the product in a predetermined manner.

The invention likewise relates to an apparatus for packaging an article, particularly a food product, such as, for example, a chocolate bar having a substantially rectangular shape, in a sealed package, which accomplishes the aforementioned process. This apparatus includes a conveyor system for transporting the products to be wrapped and an apparatus for positioning a sheet of substantially rectangular thermosealable packaging material around the product during the course of its movement by the conveyor system.

2. Description of Background and Relevant Information

To satisfy hygienic and safety standards in connection with the sale of food products such as, for example, chocolate bars, there is an increasing tendency to utilize sealed packages formed by means of thermosealable packaging material. In automatic packaging lines, the product is linearly moved by a conveyor system, during which movement the packaging material is positioned around the product. After the sealing of the flaps of the packaging material, which are formed when the sheet is initially folded around respective products, a flap of packaging material is obtained which must subsequently be folded on the lower surface of the product after the formation and the preliminary folding of the lateral folds. This operation, however, due to this extra flap, requires the product to be turned over, which generally requires difficult manipulations due to the existence of the extra flap. Accomplishing the required manipulations can prove troublesome.

SUMMARY OF THE INVENTION

It is an object of the present invention to provide a process and apparatus for packaging articles which overcome the problems in the prior art. Accordingly, the process includes the following steps:

- moving the product, with its upper surface facing upwardly, along a predetermined path by means of a linear conveyor system;
- positioning a substantially rectangular wrapper made of thermosealable material within the predetermined path of the product as the product is moved by the conveyor system, thereby folding the wrapper around the product and forming two flaps having unequal lengths extending, respectively, from the upper surface and the lower surface of the product;
- inserting the product and wrapper into a compartment of a rotary inverting device;

- moving the product and wrapper along an arcuate path by means of the rotary inverting device;
- sealing the two flaps together along the predetermined length of the product during the course of moving the product and wrapper along the arcuate path, thereby forming an extra flap extending substantially from the lower surface of the product;
- forming lateral folds in the wrapper during the course of moving the product and wrapper along the arcuate path;
- discharging the product and wrapper from the rotary inverting device after the rotary inverting device has moved the product and wrapper approximately 180° along the arcuate path, so that the lower surface of the product faces upwardly;
- sealing the lateral folds; and
- folding the extra flap and the lateral folds on the lower surface of the product.

In one embodiment, the lateral folds are first folded on the lower surface of the product, after which the extra flap is folded over the lateral folds.

In a second embodiment, the extra flap is first folded on the lower surface of the product, after which the lateral folds are folded over the extra flap. In this embodiment, a printed band is positioned around the product by overlapping two edges of a substantially rectangular sheet to thereby form a sleeve open at its ends.

According to one aspect of the invention, the step of sealing the lateral folds includes preheating the thermosealable material by means of two heated ribbons which are adapted to move substantially parallel to the movement of the product, and applying pressure upon the lateral folds by means of cooled pressure rollers.

The process further includes maintaining the lateral folds in a position substantially perpendicular to the lower surface of the product after the step of sealing the lateral folds, by means of at least one support and guidance element. The support and guidance element is moved substantially parallel to and substantially at the same speed as the product, and has a portion positioned between the lateral folds and above the lower surface of the product.

The process according to the present invention can be further characterized by the steps of:

- moving the product along a first predetermined path with its upper surface facing substantially upwardly;
- positioning a wrapper at least partially around the product at a predetermined location in the predetermined path;
- forming an extra flap with the wrapper, extending from the product, the extra flap to be folded toward the lower surface of the product;
- inverting the product and wrapper having the extra flap; and
- folding the wrapper around the product, including the step of folding the extra flap toward the lower surface of the product as the lower surface faces substantially upwardly.

According to a further aspect of the invention, the step of positioning the wrapper at least partially around the product includes the steps of inserting the wrapper into the predetermined path of the product and moving the product into the wrapper to form two flaps of unequal length extending, respectively, from the upper surface and the lower surface of the product.

The step of forming the extra flap, according to another aspect of the invention, includes the step of sealing the two flaps together along the predetermined length of the product.

A further aspect of the invention includes, subsequent to the step of forming the extra flap, the step of forming lateral folds in the wrapper.

The step of inverting the product and wrapper, according to a further aspect of the invention, includes the step of moving the product and the wrapper along a predetermined inverting path from a first position, wherein the upper surface of the product faces substantially upwardly, to a second position, wherein the lower surface faces substantially upwardly, and whereby the steps of forming the extra flap and forming the lateral folds are performed along the predetermined inverting path.

According to an additional aspect of the invention, the step of inverting is performed by a rotary inverter including at least one compartment for receiving the product and wrapper. The product and wrapper are then moved into the compartment, and the rotary inverter is rotated approximately 180°.

According to a further aspect of the invention, the product and wrapper are discharged from the compartment and moved along a second predetermined path with the lower surface facing substantially upwardly.

According to one embodiment of the invention, the steps of folding the wrapper around the product includes the steps of folding the lateral folds toward the lower surface of the product, and folding the extra flap over the lateral folds.

According to a second embodiment of the invention, the step of folding the wrapper around the product includes the steps of folding the extra flap against product, and folding the lateral folds over the extra flap. In this embodiment, a printed sheet is preferably placed around the wrapper and product in the form of a band, open at its ends.

According to a further aspect of the invention, prior to the step of folding the wrapper around the product, the lateral folds are sealed.

The apparatus according to the present invention includes:

a linear conveyor system for moving the product, with the upper surface facing upwardly, along a predetermined path from an upstream location toward a downstream location;

a device for positioning a substantially rectangular wrapper of thermosealable packaging material within the predetermined path of the product as the product moves along the predetermined path to thereby fold the wrapper around the product and to form two flaps having unequal lengths extending, respectively, from the upper surface and from the lower surface of the product;

a rotary inverting device including at least one compartment into which the product and the wrapper having the two flaps are received from the linear conveyor system;

a workstation located along the outer periphery of the rotary inverting device for sealing the two flaps together along the predetermined length of the product to thereby form an extra flap extending substantially from the lower surface of the product;

a further workstation also located along the periphery of the rotary inverting device, downstream of the sealing workstation, for forming lateral folds in the wrapper;

a device for discharging the product and wrapper from the rotary inverting device after the product has been inverted with its lower surface facing substantially upwardly, the linear conveyor system further including a section for moving the product after being discharged from the rotary inverting device;

a workstation for sealing the lateral folds;

a device for moving the product and wrapper toward an additional workstation and a device for positioning the product and the wrapper at the additional workstation;

the additional workstation includes a device for folding and gluing the lateral folds and the extra flap on the lower surface of the product.

According to a further aspect of the invention, the workstation for sealing the lateral folds includes first and second heating ribbons positioned on respective sides of the product as the product and wrapper are moved by the linear conveyor system, each of the heating ribbons being positioned to move substantially parallel to the direction of movement of the product and the wrapper as they are moved by the linear conveyor. The sealing workstation further includes at least two cooled pressure rollers for applying pressure against the lateral folds of preheated thermosealable packaging material and at least one support and guidance element for maintaining the lateral folds in a position substantially perpendicular to the lower surface of the product. The support and guidance element includes at least one pallet attached to a conveyor such that the pallet is adapted to move substantially parallel to and at substantially the same speed as the product and wrapper, as the product and wrapper are moved by the linear conveyor system. The pallet has a size and shape such that it can be engaged between the lateral folds which are positioned substantially vertically and such that it can provide support to the lateral folds as the pressure rollers apply pressure against the lateral folds.

According to a further aspect of the invention, the additional workstation includes an elevator for lifting the product and wrapper, lateral elements for folding the lateral folds, and movable folding abutments for folding the extra flap.

The apparatus of the present invention can be further characterized as:

a system for moving the product with its upper surface facing substantially upwardly along a first predetermined path from an upstream location to a downstream location;

a device for positioning a wrapper at least partially around the product at a predetermined location along the first predetermined path;

a device for forming an extra flap extending from the product, the extra flap to be folded toward the lower surface of the product;

a device for inverting the product and the wrapper having the extra flap so that the lower surface faces substantially upwardly; and a device for folding the wrapper around the product including a device for folding the extra flap toward the lower surface of the product as the lower surface faces substantially upwardly.

According to a further aspect of the invention, the device for positioning the wrapper at least partially around the product includes a device for inserting the wrapper into the first predetermined path as the product is moved by the system for moving the product to thereby form two flaps of unequal length extending, respectively, from the upper surface and from the lower surface of the product.

According to a still further aspect of the invention, the device for forming the extra flap includes a device for sealing the two flaps together along the predetermined length of the product.

According to a still further aspect of the invention, the wrapper is made of thermosealable material and the device for sealing the two flaps together includes a device for preheating the thermosealable material and for applying pressure on the two flaps.

According to a still further aspect of the invention, downstream of the device for sealing the two flaps together is a device for forming lateral folds in the wrapper.

The device for inverting the product and wrapper, according to another aspect of the invention, moves the product and wrapper along a predetermined inverting path from a first position, whereby the upper surface of the product faces substantially upwardly, to a second position, whereby the lower surface of the product faces substantially upwardly and, further, wherein the device for forming the extra flap and the device for forming the lateral folds in the wrapper are positioned along the predetermined inverting path.

The invention further includes a device for transferring the product and wrapper from the device for moving to the device for inverting.

Downstream of the device for inverting according to a further aspect of the invention, is a system for moving the product and wrapper along a second predetermined path with the lower surface of the product facing substantially upwardly.

According to a still further aspect of the invention, the device for folding the wrapper around the product includes a device for folding the lateral folds toward the lower surface of the product, and a device for folding the extra flap over the lateral folds.

According to an alternate form of the invention, the device for folding the wrapper around the product includes a device for folding the extra flap toward the lower surface of the product and for folding the lateral folds over the extra flap. In this form of the invention, a sheet is placed around the wrapper and product in the form of a band, open at its ends.

According to a still further aspect of the invention, the wrapper is made of thermosealable material and the lateral folds are sealed by a device for preheating the thermosealable material; for applying pressure against the preheated thermosealable material; and for supporting and guiding the lateral folds in a predetermined position as the product and the wrapper are moved along the second predetermined path.

BRIEF DESCRIPTION OF THE DRAWINGS

The present invention will now be described with reference to the annexed drawings given by way of nonlimiting example only in which.

DESCRIPTION OF PREFERRED EMBODIMENTS

Figure 1:
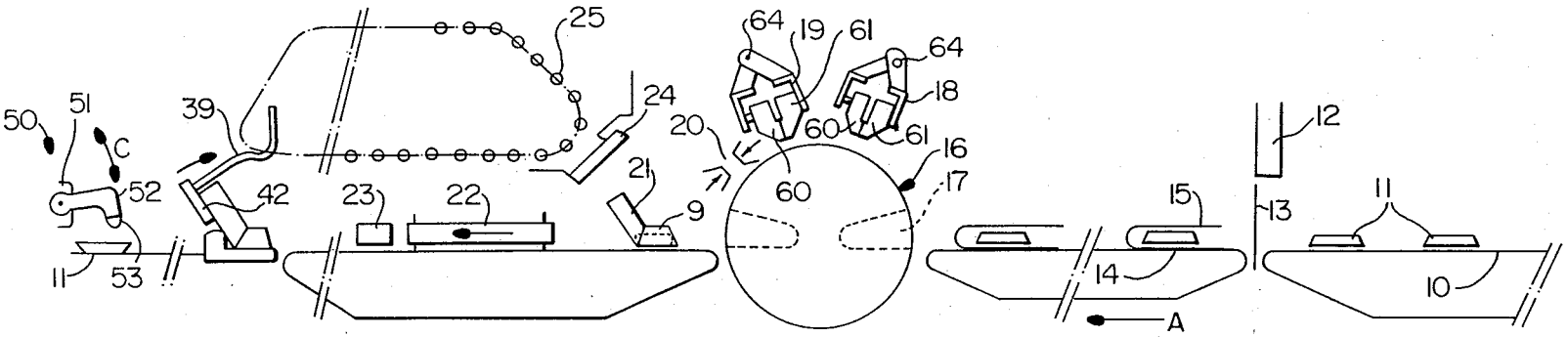
FIG. 1 illustrates a schematic view of the apparatus according to the invention.

It is an object of the present invention to overcome the problems inherent in packaging products of the apparatus and methods of the prior art by providing a succession of manipulations for which the existence of the extra flap does not present a problem.

To this end, the process according to the invention is characterized in that as the product is moved by the conveyor system, the packaging paper is introduced into the path of the product so that the paper is positioned around the product in a manner so as to form two flaps of unequal length, respectively, adjacent the major surfaces of the product. Subsequently, the product, thus covered by the packaging paper, is received in a compartment of a rotary apparatus for inverting the product, during which inversion the flaps are sealed on one another along a longitudinal edge of the product. An extra flap is thereby positioned substantially in the extension of the major lower surface of the product, and lateral folds are formed. After having been inverted by the inverting apparatus being rotated approximately 180°, the partially packaged product is then removed from the rotary inverter. The lateral folds are then sealed and the flap and the lateral folds are then folded on the lower surface of the product, the lower surface being directed upwardly after inversion of the product.

According to a first embodiment of the invention, the lateral folds are first folded and the extra flap is subsequently folded over the lateral folds. The extra flap is thus folded toward the lower surface of the product.

According to a second embodiment of the invention the extra flap is first folded and the lateral folds are subsequently folded over the extra flap. A printed band is then positioned around the product, the band being constituted by a rectangular sheet positioned around the product in a manner so as to form a sleeve open at its ends in a manner so as to overlap two edges of the folded packaging sheet.

According to a preferred embodiment, the lateral folds are sealed by preheating thermosealable packaging material by means of two heating ribbons adapted to move parallel to the movement of the product which is positioned on the linear conveyor system. Pressure is then exerted on the lateral folds of preheated thermosealable material by means of cooled pressure elements, the folds being maintained in a position which is substantially perpendicular to the major surfaces of the product by at least one support and guidance element.

The lateral folds are sealed by displacing the support and guidance element parallel to and at the same velocity as the product, this element being positioned between two folds and above the upwardly facing surface of the product.

The apparatus according to the invention includes an apparatus for simultaneously moving the product and the wrapping paper on the linear conveyor system and folding the sheet of wrapping paper around the product in a manner so as to form two flaps of unequal lengths respectively, adjacent the major surfaces of the product; an apparatus for inverting the product, including at least one compartment to receive a product which is thus covered by the wrapping paper; an apparatus for sealing the flaps on one another along the length of a longitudinal edge of the product, which serves to form a flap positioned substantially in the extension of the major lower surface of the product; an apparatus for forming the lateral folds; an apparatus for removing the partially packaged product from the compartment of the inverter after the product has been turned over; an apparatus for sealing the lateral folds; and an apparatus for bringing the product into position in at least one workstation which is adapted to fold the extra flap and the lateral folds, and for affixing the extra flap on the lower surface of the product, this surface facing upwardly after having bee inverted.

According to a preferred embodiment, the apparatus for sealing the lateral folds includes a heating ribbon positioned on either side of the product; an apparatus for moving the ribbons substantially parallel to the movement of the products on the linear conveyor system; and at least two cooled pressure elements for exerting a pressure on the lateral folds of the preheated thermosealable packaging material, the lateral folds being maintained in a position which is substantially perpendicular to the major surfaces of the product by at least one support and guidance element.

The support and guidance element for the lateral folds is preferably constituted by a pallet mounted on a conveyor belt which is adapted to displace the pallet substantially parallel to the movement of the products and at the same speed, the pallet having dimensions and a shape such that it can engage the partially wrapped product between the lateral folds positioned substantially vertically and provide support for the lateral folds when they are subjected to the pressure of the pressure elements.

The workstation adapted to fold the extra flap preferably includes an elevator apparatus for lifting the product, lateral elements for folding the lateral folds and movable folding abutments for folding the extra flap.

With reference to the schematic illustration of FIG. 1, the apparatus according to the invention includes a linear conveyor system including a conveyor 10 constituted, e.g., by a belt conveyor including, e.g., a single belt or one or more laterally adjacent endless ribbon conveyor belts or any other known means for transporting products 11. Linearly downstream of conveyor 10 can be one or more conveyors similar to conveyor 10.

In the example shown, the products 11 are chocolate bars. It is to be noted that chocolate bars are relatively delicate products and have a substantial thickness; the sides are generally inclined due to the fact that the product is molded and must be able to be taken out of the mold. The packaging material ought to be folded and sealed around the product and because of the thickness of the product, the folds ought to be formed in a precise manner to assist the proper operation of the folding mechanisms.

An apparatus 12 makes it possible to distribute sheets 13 of substantially rectangular shape of a thermosealable packaging material into the path of the chocolate bars. These sheets are moved by the product as they are displaced in the direction of arrow A and are folded around the front surface of the product in a manner so as to form two flaps 14 and 15 of unequal lengths. It is in this manner that the product, partially wrapped in the sheet of thermosealable packaging material 13, is brought to a rotary inverting apparatus 16 including receiving compartments 17 adapted to receive the products and to rotate them approximately 180° in the direction of arrow B to thereby turn them over. At least three workstations are located around the periphery of the inverter 16 for performing certain operations on the wrapper of the product. Specifically, during displacement of inverter 16, flap 15 is sealed against flap 14 by means of a first gripper 18 which is adapted to preheat the thermosealable material and by means of a second gripper 19 positioned downstream of gripper 18, which is adapted to apply pressure on the two flaps and to cool the preheated thermosealable material.

The grippers 18 and 19, which are of identical construction but one of which (18) includes heating mechanisms (not illustrated) and the other of which (19) includes cooling mechanisms (not illustrated) includes two jaws 60 and 61, respectively independent of two levers, 62 and 63, articulated one with respect to the other at 64.

Figure 2:
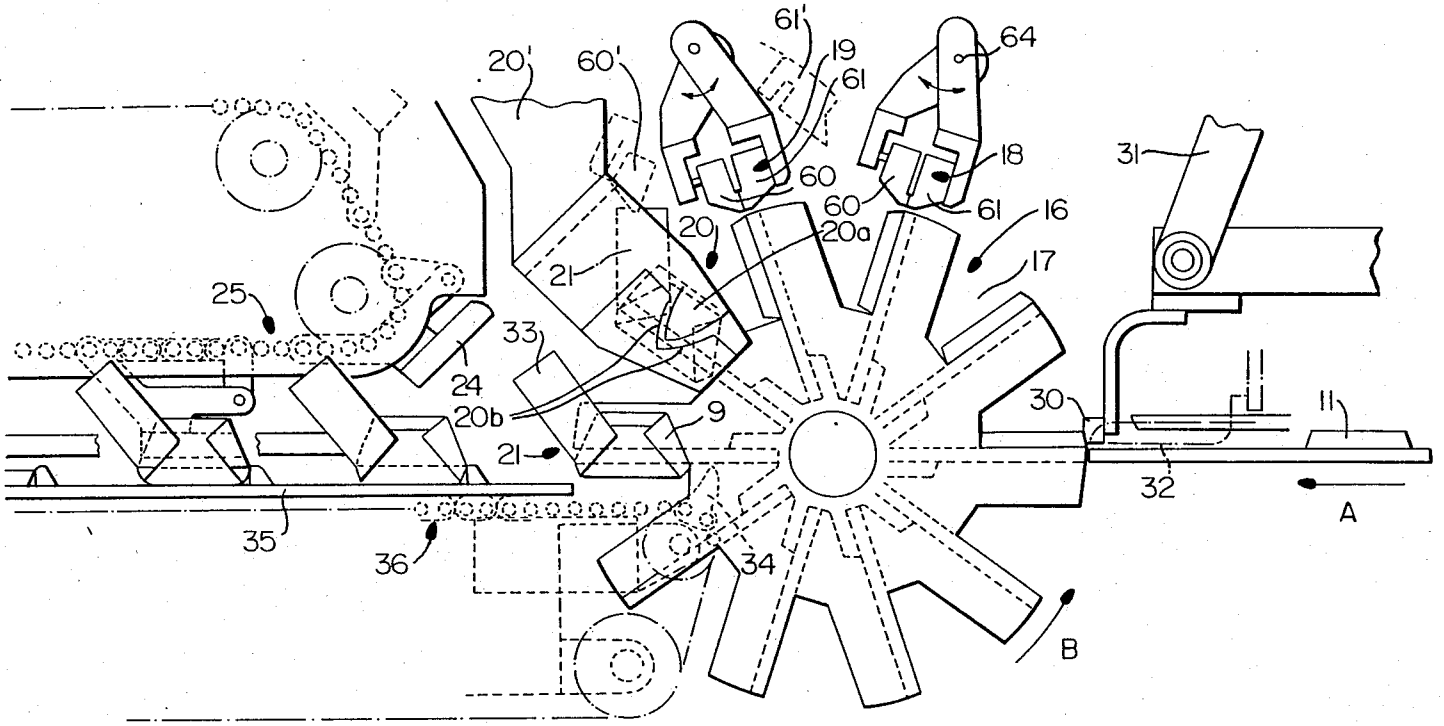
FIG. 2 illustrates a detailed view of the rotary inverting apparatus.

Pneumatic or hydraulic mechanical control mechanisms permit the opening of the two jaws 60 and 61, which is shown more particularly by FIG. 2, to lead them into the positions 60' and 61' illustrated in broken line.

A box-like folding device 20 mounted on support 20' forms the extra flap 21 which is created by the portion of flap 15 which extends beyond flap 14 after the sealing of the flaps, at the same time that the lateral folds 9 are formed adjacent the small lateral sides of the product.

The folding box 20, is known in and of itself and exists on many of the traditional chocolate bar conditioning machines. It is composed of two central flappers 20A and two pairs of folding lateral ramps 20B which have respective functions of preparing and then forming lateral folds 9.

The partially wrapped product is then extracted from the rotary inverting apparatus. The product is thereupon positioned on its upper surface, called the "mirror" in the case of a chocolate bar, which makes it possible to fold the lateral folds and the extra flap 21 on the bar's lower surface which faces upwardly as a result of the inverting manipulation. This last folding operation is described subsequently.

Before this last folding operation, the product moves through a workstation which includes a sealing apparatus for sealing the lateral folds. The apparatus includes two lateral heating bands 22 which are moved in parallel and, if desired, at the same speed as the movement of the product on the linear conveyor system. These two heating bands 22 serve to preheat the thermosealable packaging material at the location of the lateral folds. This sealing apparatus also includes two pressure elements 23 which can be rollers, for example, adapted both to exert lateral pressure on the lateral folds and to cool the preheated thermosealable packaging material.

The sealing apparatus furthermore includes support and guidance elements for the lateral folds constituted by pallets 24 mounted on a conveyor 25 adapted to move the pallets substantially parallel to and at the same speed as the movement of the product. These pallets have a shape and dimensions such that they can be positioned above the upwardly facing major surface of the bar, between the vertically oriented lateral folds, and serve as a support to oppose the pressure of the pressure rollers 23. The lateral folds are necessarily maintained substantially vertically during this sealing operation since the two superimposed sheets which form each of the two folds are displaced relative to one another at the moment they are brought from the horizontal position into the vertical position. To avoid improper folds and wrinkling of the packaging material at the moment of folding over the lateral folds against the lower surface of the product, these folds must be sealed in the substantially vertical position and require, therefore, an interior support to resist the pressure exerted by the pressure rollers. This process guarantees a regular preheating and a correct and reliable sealing.

At the output of the sealing workstation, the product is moved towards a workstation, illustrated in detail in FIG. 3 and which will be described in more detail subsequently, which both folds over the lateral folds 9 and folds extra flap 21 on the major surface of the product or chocolate bar. Extra flap 21 is preferably glued by a line of glue or dots of glue, and/or by sealing it against the exterior surface of the packaging material already covering the lower surface of the product at sealing workstation 50.

Sealing workstation 50 includes a fixed support 51 and an arm 52 articulated on the support which preferably carries several sealing heads 53 which can be heated to an adequate temperature to assure sealing of the point of packaging material. The arm 52 can pivot in the two opposite directions illustrated by the double arrow C. This apparatus assures the sealing of the flap 21 on the lower surface of product 11.

The products are led continuously to the rotary inverting apparatus 16. This apparatus advances intermittently and leads the product successively opposite the grippers 18 and 19, and to the folding box 20. At the end of the rotary inverting apparatus 16, the products are taken up again continuously and are led to the flapping station for the lateral folds 9 and flap 21, and then to the sealing station 50 for this flap. The products advance intermittently by the conveyor system through these two stations.

This continuous-intermittent progress is due to the fact that certain stations (grippers 18 and 19 and folding box 20 for creation of the flap 21 and the lateral folds 9, and sealing) are fixed and that the products must stop at the respective stations during a predetermined interval of time.

With reference to FIG. 2, the rotary inverting apparatus 16 is composed of a wheel, at the periphery of which is provided a series of radially oriented compartments 17. Products 11 are preferably pushed within respective compartments 17, which are positioned to face a linear conveyor, by means of a pusher 30 affixed to the end of an arm 31 which is associated with a drive mechanism (not shown) which displaces the pusher along a trajectory 32 shown in dashed lines. It is also conceivable that the partially wrapped products can be directly received by the inverter 16 without the assistance of pusher 30. The products which are partially wrapped in the sheet of thermosealable packaging material are rotated to the workstation that includes gripper 18 corresponding to a first preheating phase whose role has been defined above. They are then brought to the workstation that includes gripper 19 corresponding to a cooling phase which makes it possible to perform sealing of the two flaps 14 and 15. Folding device 20 then positions the lateral folds 9 thereby raising extra flap 21 which includes a central portion and two raised ends forming lateral wings 33 provided on both sides of the central portion.

After the product has been rotated approximately 180° by the rotary inverter, it is pushed from the compartment 17 by a finger 34 which moves the product along the length of a guide 35 to the last workstation described with reference to FIG. 3. Fingers 34 are affixed to a drive belt 36 and constitute with guide 35 a linear conveyor adapted to bring the product to the last workstation.

Figure 3:
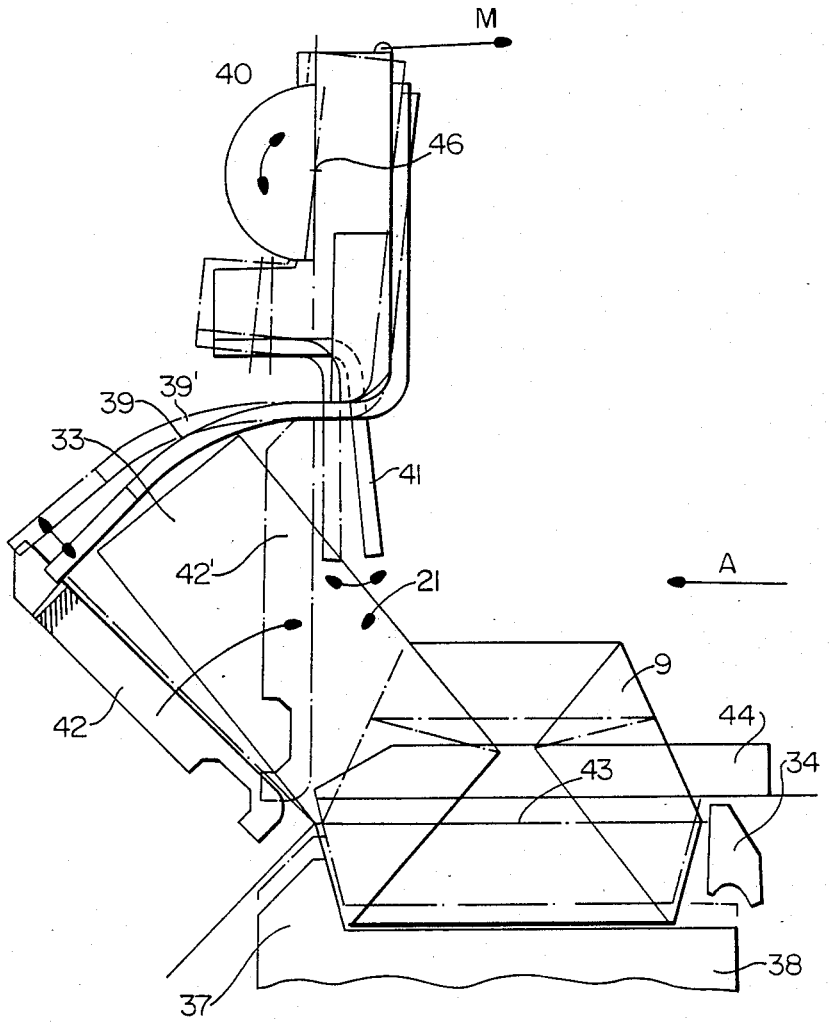
FIG. 3 illustrates a schematic view of the workstation for folding the lateral folds and the extra flap.

FIG. 3 illustrates the workstation adapted to ensure the folds for the lateral folds and extra flap 21 prior to final sealing. For this purpose, finger 34 pushes the product to be supported against an abutment 37 positioned at the end of an elevator apparatus 38 adapted to lift the product. An abutment 39 is affixed on pivoting support 40 to engage extra flap 21 and lateral wings 33, positioned on both sides of the planar portion of the extra flap, in a predetermined position during the arrival of the product in the direction of arrow A. M is a pull handle or a rod which is pulled by a hydraulic or pneumatic jack or by an electromagnet or is coupled to a drive cam, which causes support 40 to pivot around its pivoting point 46.

Support 40 furthermore includes folding templates 41 which are, preferably, two substantially vertically extending shafts (only one of which can be seen in the figure) which are adapted to form the folds at locations which have been perfectly predetermined and are accomplished as follows. When support 40 pivots, abutment 39 moves into position 39' and frees the passage of flap 21 therealong by element 42. After such movement of support 40, the two folding templates 41 are positioned substantially vertically to the angles formed by the flap 21 and the lateral folds 9 to define the portion of the folds, and flap 21 is pushed back by element 42, which moves into position 42'. Element 42 is preferably driven by a cam (not shown), although other driving mechanisms could alternatively be employed. Therefore, the folds are made when movable folding element 42 begins the folding of extra flap 21 by moving from the position shown in solid lines identified by 42 to the position identified by 42' shown in dashed lines, after elevator element 38 rises, which thereby lifts the product into a relatively precise position; lateral movable folders 44 move to fold the lateral folds 9 (see FIG. 6A also); and extra flap 21 then forms an acute angle with the product and is folded on the product by the fixed edge of the movable element 42 as the product is displaced by finger 34 as the product is again moved in direction A by the conveyor system.

Depending upon the final desired appearance, the folding of the packaging material on the product can be accomplished in two different manners. For example, lateral wings 33 can be folded before extra flap 21 or, alternatively, extra flap can be folded before lateral wings 33. The arrangement and proper sequential operation of lateral folders 44 and pivoting support 40, including the associated mechanism, is performed accordingly.

Figure 4:
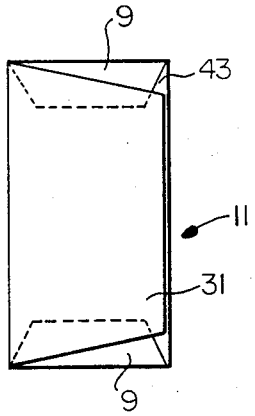
FIG. 4 illustrates a first folding configuration of the packaging material wrapped around a product.

With reference to FIG. 4, in a first folding step lateral folds 9 of the wrapping material are folded and affixed on the lower surface 43 of product 11, and in a second step extra flap 21 is folded and affixed on the folded lateral folds. This form of folding requires that the lateral folds and the extra flap have sufficiently large dimensions so that the wrapped product has the appearance of a well-finished product. Consequently, this mode of operation entails a relatively high consumption of wrapping material.

Figure 5:
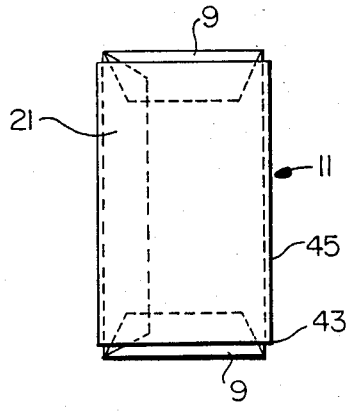
FIG. 5 illustrates a second folding configuration of the material wrapped around the product with the addition of an open-sleeve band.

In a second folding method, whereby the wrapped product is illustrated by FIG. 5, extra flap 21 is folded first and is then affixed on the lower surface 43 of product 11. In the second step, the lateral folds 9 are folded and affixed on folded extra flap 21. Since the wrapped product after this second step does not have the appearance of a well-finished product since the lateral folds remain visible, in a third step the wrapped product is surrounded with a band 45, a printed sheet of paper. This band is formed by overlapping two edges of the sheet of paper to thereby form a sleeve open at its ends. This form of folding allows for an extra flap 21 having dimensions less than those necessary in the other form and results in an economy of wrapping material.

The affixation of the extra flap occurs in a known manner by means of one or more lines or points of glue positioned on one of the two surfaces of the wrapping material in contact with one another on the lower surface 43 of the product, and/or by sealing as discussed above with regard to workstation 50.

Figures 6A, 6B:
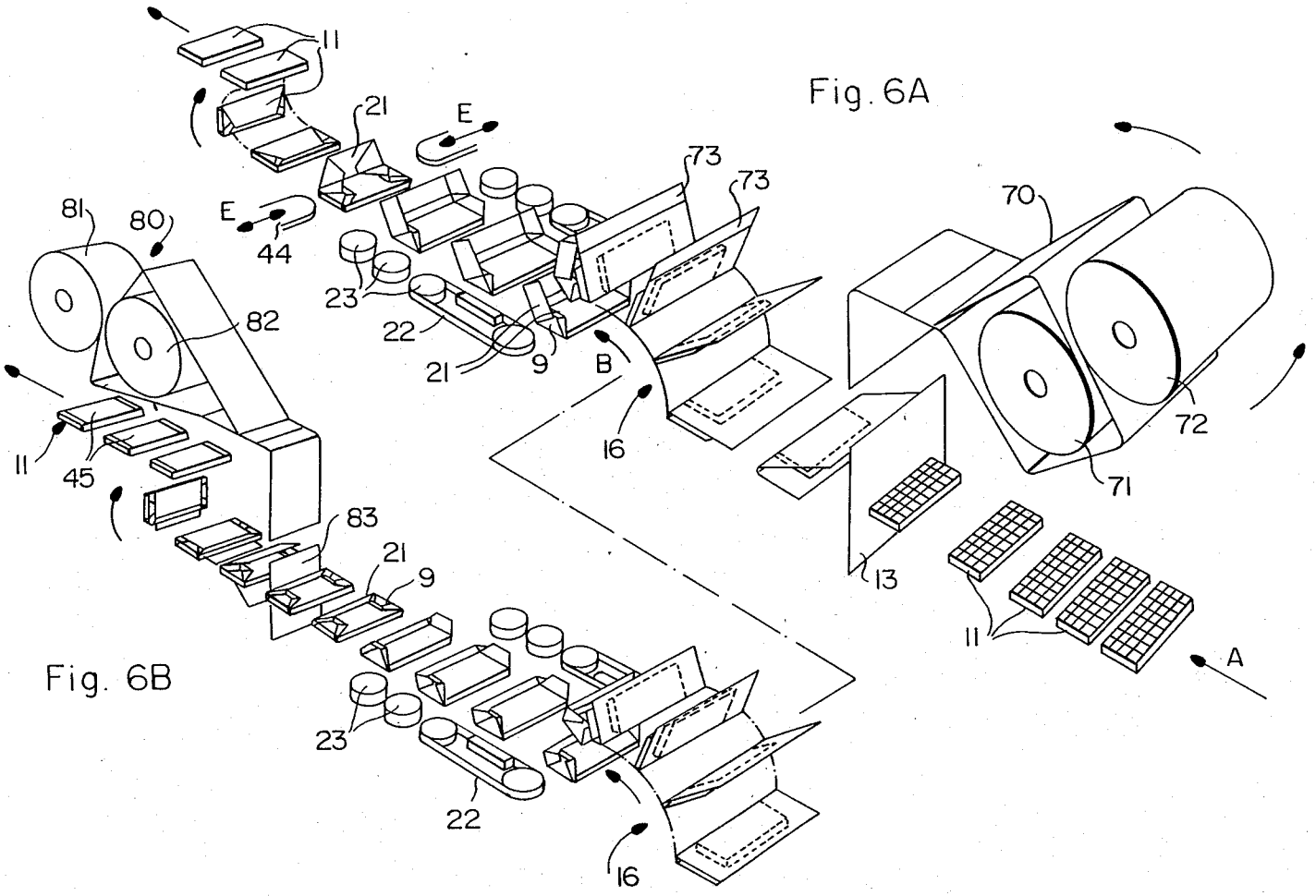
FIGS. 6A and 6B represent, respectively, perspective views illustrating the embodiment for packaging the article as shown in FIG. 4 and the packaging embodiment of the article as shown in FIG. 5.

FIG. 6A illustrates the progress of conditioning corresponding to the packaging configuration of FIG. 4. The products 11, which are preferably chocolate bars, are led in the direction of arrow A. The sheets of packaging material 13 issuing from a feeding apparatus 70 to rollers 71 and 72 are led into the path of the bars, and then wrapped around the bars.

These bars are then introduced into the rotary inverting apparatus 16 which turns intermittently in the direction of the arrow B. The grippers 18 and 19 (not illustrated in this figure) assure the sealing of the two surfaces of the packaging material to form a tubular package 73 around the bar.

The folding box 20 (not illustrated in FIG. 6A) forms lateral folds 9 and the extra flap 21.

The lateral heating bands 22 heat the thermosealable material in the zone of the lateral folds and the presser rollers 23 accomplish the sealing of these lateral folds.

The lateral folders 44, which move in the direction of the double arrows E, secure the positioning of these folds and an apparatus (see FIG. 3) refolds the flap 21. This flap is then sealed by the apparatus 50 (see FIG. 1).

The turning apparatuses known in the field and not represented, turn the bars 11 before discharging them.

FIG. 6B takes up the elements of FIG. 6A from the rotary turning apparatus 16. The conditioning is carried out as above until the positioning of the lateral folds 9 and that of the flap 21.

The bars are furthermore destined to receive a band 45 in this embodiment. To this end, the conditioning line includes a feeding station 80 with rollers 81 and 82 of packaging material. It consists generally of a sheet of printed paper. Sheet 83 is cut and placed in the path of the bars, and then it is folded in such a manner as to form a sheath around the product. The two longitudinal sides are superimposed and then glued to each other.

These different operations have made it possible first to perform the sealing of the wrapper along the length of one of the longitudinal edges of the product and to then perform a lateral sealing at the location of the lateral folds. Consequently, the product is wrapped in a sealed fashion which satisfies present requirements as to safety and hygiene.

It is to be understood that certain functions can be fulfilled by means slightly different than those which have been utilized in the embodiments illustrated in the figures and disclosed above. Thus, the apparatus for inverting the product followed by a linear conveyor could be fulfilled by a larger apparatus for inverting the product or by plurality of apparatuses of this type provided one after another and providing at their peripheries a group of workstations making it possible to perform all of the required operations.

Although the invention has been described with reference to particular means, materials and embodiments, it is to be understood that the invention is not limited to the particulars disclosed and extends to all equivalents within the scope of the claims.

We claim:

1. A process for wrapping a product having a predetermined length, an upper surface, and a lower surface, said process comprising the steps of:

(a) moving said product, with said upper surface facing substantially upwardly, along a predetermined path by means of a linear conveyer system;

(b) positioning a substantially rectangular wrapper made of thermosealable material within said predetermined path of said product as said product moves along said predetermined path thereby folding said wrapper around said product and forming two flaps having unequal lengths extending, respectively, from said upper surface and said lower surface of said product;

(c) inserting said product and wrapper into a compartment of a rotary inverting device;

(d) moving said product and wrapper along an arcuate path by means of said rotary inverting device;

(e) sealing said two flaps together along said predetermined length of said product during the course of moving said product and wrapper along said arcuate path, thereby forming an extra flap extending substantially from said lower surface of said product;

(f) forming lateral folds in said wrapper during the course of moving said product and wrapper along said arcuate path;

(g) discharging said product and wrapper from said rotary inverting device after said rotary inverting device has moved said product and wrapper approximately 180° along said arcuate path, so that said lower surface of said product faces substantially upwardly;

(h) sealing said lateral folds including preheating said thermosealable material by means of two heated ribbons which are adapted to move substantially parallel to the movement of said product, and applying pressure upon said lateral folds by means of cooled pressure rollers, wherein said process further comprises maintaining said lateral folds in a position substantially perpendicular to said lower surface of said product after said step of sealing said lateral folds, by means of at least one support and guidance element; and (i) folding said extra flap and said lateral folds on said lower surface of said product.

2. The process of claim 1, wherein said lateral folds are first folded on said lower surface of said product, after which said extra flap is folded over said lateral folds.

3. The process of claim 1, wherein said extra flap is first folded on said lower surface of said product, after which said lateral folds are folded over said extra flap, and wherein said process further comprises positioning a printed band, comprising a substantially rectangular sheet, around said product, thereby overlapping two edges of said sheet to thereby form a sleeve open at its ends.

4. The process of claim 1, wherein during said step of maintaining said lateral folds, said support and guidance element is moved substantially parallel to and substantially at the same speed as said product, said support and guidance element having a portion positioned between said lateral folds and above said lower surface of said product.

5. An apparatus for wrapping a product having a predetermined length, an upper surface, and a lower surface, comprising:

(a) a linear conveyer system for moving said product, with said upper surface facing substantially upwardly, along a predetermined path from an upstream location toward a downstream location;

(b) an apparatus for positioning a substantially rectangular wrapper of thermosealable packaging material within said predetermined path of said product as said product moves along said predetermined path adapted to thereby fold said wrapper around said product and to form two flaps having unequal lengths extending, respectively, from said upper surface and from said lower surface of said product;

(c) a rotary inverting device comprising an outer periphery and at least one compartment into which said product and said wrapper having said two flaps are received from said linear conveyer system;

(d) means located along said outer periphery of said rotary inverting device for sealing said two flaps together along said predetermined length of said product to thereby form an extra flap extending substantially from said lower surface of said product;

(e) means located along said periphery of said rotary inverting device, downstream of said means for sealing, for forming lateral folds in said wrapper;

(f) means for discharging said product and said wrapper from said rotary inverting device after said product has been inverted with said lower surface facing substantially upwardly, said linear conveyer system further comprising means for moving said product after being discharged from said rotary inverting device;

(g) means for sealing said lateral folds after said lateral folds have been formed, said means for sealing said lateral folds comprises first and second heating ribbons positioned on respective sides of said product as said product and said wrapper are moved by said linear conveyer system, each of said heating ribbons being positioned to move substantially parallel to the direction of movement of said product and said wrapper as they are moved by said linear conveyer; said means for sealing further comprising at least two cooled pressure rollers for applying pressure against said lateral folds of preheated thermosealable packaging material and at least one support and guidance element for maintaining said lateral folds in a position substantially perpendicular to said lower surface of said product after said lateral folds have been sealed;

(h) means for moving said product and said wrapper toward a workstation located downstream from said means for sealing said lateral folds and means for positioning said product and said wrapper at said workstation;

(i) said workstation comprising means for folding and gluing said lateral folds and said extra flap on said lower surface of said product.

6. The apparatus of claim 5, wherein said at least one support and guidance element comprises at least one pallet attached to a conveyor such that said pallet is adapted to move substantially parallel to and at substantially the same speed as said product and said wrapper, as said product and said wrapper are moved by said linear conveyor system, said at least one pallet having a size and shape such that it can be engaged between said lateral folds which are positioned substantially vertically and such that it can provide support to said lateral folds as said pressure rollers apply pressure against said lateral folds.

7. The apparatus of claim 5, wherein said workstation further comprises an elevator for lifting said product and said wrapper, lateral elements for folding said lateral folds, and movable folding abutments for folding said extra flap.

8. A process for wrapping a article having a predetermined length, an upper surface, and a lower surface, said process comprising the steps of:

(a) moving said article along a first predetermined path with said upper surface facing substantially upwardly;

(b) positioning a wrapper at least partially around said article at a predetermined location in said predetermined path, said wrapper forming two flaps extending, respectively, from said upper surface and said lower surface of said article;

(c) forming an extra flap from said two flaps with said wrapper extending from said article, said extra flap to be folded toward said lower surface of said article and sealing said two flaps of said extra flap together only along said predetermined length of said article;

(d) inverting said article and said wrapper having said extra flap;

(e) folding said wrapper around said article, comprising the step of folding said extra flap toward said lower surface of said article as said lower surface faces substantially upwardly; and (f) subsequent to said step of forming said extra flap, forming lateral folds in said wrapper.

9. The process of claim 8, wherein said step of positioning said wrapper at least partially around said article comprises the steps of inserting said wrapper into said predetermined path of said article and moving said article into said wrapper to form two flaps of unequal length extending, respectively, from said upper surface and said lower surface of said article.

10. The process of claim 8, wherein said step of inverting said article and said wrapper comprises moving said article and said wrapper along a predetermined inverting path from a first position, wherein said upper surface of said article faces substantially upwardly, to a second position, wherein said lower surface faces substantially upwardly, and whereby said steps of forming said extra flap and forming said lateral folds are performed along said predetermined inverting path.

11. The process of claim 8, whereby said step of inverting is performed by a rotary inverter comprising at least one compartment for receiving said article and said wrapper, said process further comprising moving said article and said wrapper into said compartment, whereby said step of inverting comprises rotating said rotary inverter approximately 180°.

12. The process of claim 11, further comprising the steps of discharging said article and said wrapper from said compartment and moving said article and said wrapper along a second predetermined path with said lower surface facing substantially upwardly.

13. The process of claim 8, whereby said steps of folding said wrapper around said article comprises the steps of folding said lateral folds toward said lower surface of said article, and folding said extra flap over said lateral folds.

14. The process of claim 8, whereby said step of folding said wrapper around said article comprises the steps of folding said extra flap against article, and folding said lateral folds over said extra flap.

15. The process of claim 14, further comprising the step of placing a sheet around said wrapper and said article in the form of a band, open at its ends.

16. The process of claim 8, further comprising, prior to said step of folding said wrapper around said article, the step of sealing said lateral folds.

17. An apparatus for wrapping a article having a predetermined length, an upper surface, and a lower surface, comprising:

(a) means for moving said article with said upper surface facing substantially upwardly along a first predetermined path from an upstream location to a downstream location;

(b) means for positioning a wrapper at least partially around said article at a predetermined location along said first predetermined path, so that two flaps extend, respectively, from said upper surface and said lower surface of said article;

(c) means for forming an extra flap from said two flaps with said wrapper extending from said article, said extra flap to be folded toward said lower surface of said article, and means for sealing said two flaps of said extra flap together only along said predetermined length of said article;

(d) means for inverting said article and said wrapper having said extra flap so that said lower surface faces substantially upwardly;

(e) means for folding said wrapper around said article comprising means for folding said extra flap toward said lower surface of said article as said lower surface faces substantially upwardly; and (f) means for forming lateral folds in said wrapper located downstream of said means for sealing said two flaps together.

18. The apparatus of claim 17, wherein said means for positioning a wrapper at least partially around said article comprises means for inserting said wrapper into said first predetermined path as said article is moved by said means for moving said article to thereby form two flaps of unequal length extending, respectively, from said upper surface and from said lower surface of said article.

19. The apparatus of claim 17, wherein said wrapper comprises thermosealable material and wherein said means for sealing said two flaps together comprises means for preheating said thermosealable material and means for applying pressure on said two flaps.

20. The apparatus of claim 17, wherein said means for inverting said article and said wrapper moves said article and said wrapper along a predetermined inverting path from a first position, whereby said upper surface of said article faces substantially upwardly, to a second position, whereby said lower surface of said article faces substantially upwardly and, further, wherein said means for forming said extra flap and said means for forming said lateral folds in said wrapper are positioned along said predetermined inverting path.

21. The apparatus of claim 17, further comprising means for transferring said article and said wrapper from said means for moving to said means for inverting.

22. The apparatus of claim 17, further comprising, downstream of said means for inverting, means for moving said article and said wrapper along a second predetermined path with said lower surface of said article facing substantially upwardly.

23. The apparatus of claim 17, wherein said means for folding said wrapper around said article comprises means for folding said lateral folds toward said lower surface of said article, and means for folding said extra flap over said lateral folds.

24. The apparatus of claim 17, wherein said means for folding said wrapper around said article comprises means for folding said extra flap toward said lower surface of said article and means for folding said lateral folds over said extra flap.

25. The apparatus of claim 24, further comprising means for placing a sheet around said wrapper and said article in the form of a band, open at its ends.

26. The apparatus of claim 17, further comprising means for sealing said lateral folds upstream of said means for folding said wrapper around said article.

27. The apparatus of claim 26, wherein said wrapper comprises thermosealable material and wherein said means for sealing said lateral folds comprises means for preheating said thermosealable material; means for applying pressure against said preheated thermosealable material; and means for supporting and guiding said lateral folds in a predetermined position as said article and said wrapper is moved along said second predetermined path.

* * * * *

UNITED STATES PATENT AND TRADEMARK OFFICE

CERTIFICATE OF CORRECTION

PATENT NO. : 4,909,019

DATED : March 20, 1990

INVENTOR(S) : Rene DELACRETAX et al.

It is certified that error appears in the above-identified patent and that said Letters Patent is hereby corrected as shown below:

column 7, line 16, change "bee" to ——been——;
column 8, line 25, change "line" to ——lines——;
column 10, line 33, change "portion" to ——position——;
column 10, line 54, insert ——21—— after "flap";
column 14, line 21, in claim 8, line 1 change "a" to ——an—— after "wrapping";
column 15, line 13, in claim 14, line 3 insert ——said—— after "against";
column 15, line 21, in claim 17, line 1 change "a" to ——an—— after "wrapping"; and
column 16, line 51, in claim 27, line 8 change "is" to ——are——.

Signed and Sealed this

Third Day of September, 1991

*Attest:*

*Attesting Officer*

HARRY F. MANBECK, JR.

*Commissioner of Patents and Trademarks*